US009748029B2

(12) United States Patent
Shingaki et al.

(10) Patent No.: US 9,748,029 B2
(45) Date of Patent: *Aug. 29, 2017

(54) METHOD OF PRODUCING GRAIN-ORIENTED ELECTRICAL STEEL SHEET

(71) Applicant: JFE STEEL CORPORATION, Tokyo (JP)

(72) Inventors: Yukihiro Shingaki, Kurashiki (JP); Takeshi Imamura, Kurashiki (JP); Ryuichi Suehiro, Kurashiki (JP); Makoto Watanabe, Okayama (JP)

(73) Assignee: GINZA MARONIE P.C., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/415,027

(22) PCT Filed: Jul. 25, 2013

(86) PCT No.: PCT/JP2013/070187

§ 371 (c)(1),
(2) Date: Jan. 15, 2015

(87) PCT Pub. No.: WO2014/017591

PCT Pub. Date: Jan. 30, 2014

(65) Prior Publication Data

US 2015/0170813 A1 Jun. 18, 2015

(30) Foreign Application Priority Data

Jul. 26, 2012 (JP) ..... 2012-165523

(51) Int. Cl.

| | |
|---|---|
| ***C22C 38/04*** | (2006.01) |
| ***H01F 1/147*** | (2006.01) |
| ***C21D 8/12*** | (2006.01) |
| ***C22C 38/00*** | (2006.01) |
| ***C22C 38/60*** | (2006.01) |
| ***H01F 1/16*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |

(Continued)

(52) U.S. Cl.

CPC ..... *H01F 1/14775* (2013.01); *B21B 1/026* (2013.01); *B21B 45/004* (2013.01); *B21H 7/00* (2013.01); *C21D 6/001* (2013.01); *C21D 6/002* (2013.01); *C21D 6/005* (2013.01); *C21D 6/008* (2013.01); *C21D 8/12* (2013.01); *C21D 8/1222* (2013.01); *C21D 8/1233* (2013.01); *C21D 8/1261* (2013.01); *C21D 8/1272* (2013.01); *C21D 8/1283* (2013.01); *C21D 9/46* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/18* (2013.01); *C22C 38/34* (2013.01); *C22C 38/60* (2013.01); *H01F 1/14791* (2013.01); *H01F 1/16* (2013.01); *H01F 41/02* (2013.01); *C21D 2201/05* (2013.01)

(58) Field of Classification Search

CPC ..... C22C 38/00; C22C 38/02; C22C 38/04; C22C 38/06; C21D 1/26; C21D 8/1244

See application file for complete search history.

(56) References Cited

U.S. PATENT DOCUMENTS 4,898,626 A * 2/1990 Shoen ..... C21D 1/26 148/111
4,975,127 A 12/1990 Kurosawa et al.

(Continued)

FOREIGN PATENT DOCUMENTS

CN 101454465 A 6/2009
EP 2 213 754 A1 8/2010

(Continued)

OTHER PUBLICATIONS

Human English Translation of JP S 63-105926A of Iwamoto et al. dated May 11, 1988.*

(Continued)

*Primary Examiner* — Roy King
*Assistant Examiner* — Jophy S Koshy
(74) *Attorney, Agent, or Firm* — Oliff PLC

(57) ABSTRACT

In a method of producing a grain-oriented electrical steel sheet by hot rolling a steel slab having a chemical composition comprising C: 0.001 to 0.10 mass %, Si: 1.0 to 5.0 mass %, Mn: 0.01 to 0.5 mass %, S and/or Se: 0.005 to 0.040 mass %, sol. Al: 0.003~0.050 mass % and N: 0.0010 to 0.020 mass %, subjecting to single cold rolling or two or more cold rollings including an intermediate annealing therebetween to a final thickness, performing primary recrystallization annealing, and thereafter applying an annealing separator to perform final annealing, a temperature range of 550° C. to 700° C. in a heating process of the primary recrystallization annealing is rapidly heated at an average heating rate of 40 to 200° C./s, while any temperature zone of from 250° C. to 550° C. is kept at a heating rate of not more than 10° C./s for 1 to 10 seconds, whereby the refining of secondary recrystallized grains is attained and grain-oriented electrical steel sheets are stably obtained with a low iron loss.

2 Claims, 2 Drawing Sheets

(51) Int. Cl.

| | |
|---|---|
| ***C22C 38/18*** | (2006.01) |
| ***B21B 1/02*** | (2006.01) |
| ***B21B 45/00*** | (2006.01) |
| ***B21H 7/00*** | (2006.01) |
| ***C21D 6/00*** | (2006.01) |
| ***C21D 9/46*** | (2006.01) |
| ***C22C 38/34*** | (2006.01) |
| ***H01F 41/02*** | (2006.01) |

(56) References Cited

U.S. PATENT DOCUMENTS

| | | | |
|---|---|---|---|
| 2009/0165895 | A1 | 7/2009 | Ushigami et al. |
| 2015/0170813 | A1 | 6/2015 | Shingaki et al. |
| 2015/0187473 | A1 | 7/2015 | Imamura et al. |

FOREIGN PATENT DOCUMENTS

| | | | |
|---|---|---|---|
| JP | S63-105926 | A | 5/1988 |
| JP | H07-62436 | A | 3/1995 |
| JP | H07-62437 | A | 3/1995 |
| JP | H07-312308 | A | 11/1995 |
| JP | H10-130729 | A | 5/1998 |
| JP | H10-298653 | A | 11/1998 |
| JP | 2000-204450 | A | 7/2000 |
| JP | 2003-027194 | A | 1/2003 |
| JP | 2008-001979 | A | 1/2008 |
| JP | 2008-001983 | A | 1/2008 |
| JP | 2008-266727 | A | 11/2008 |
| JP | 2013-047383 | A | 3/2013 |
| JP | 2013-139629 | A | 7/2013 |

OTHER PUBLICATIONS

English Machine Translation of JP 2013047383 A of Kamisaka et al. published Mar. 7, 2013.*
STIC Human Oral Translation of ¶[0015] of JP 2013047383 A of Kamisaka et al. published Mar. 7, 2013.*
Search Report issued in PCT/JP2013/070187 mailed Oct. 15, 2013.
Jan. 27, 2015 International Preliminary Report on Patentability issued in Application No. PCT/JP2013/070187.
Shiraiwa et al, Recrystallization Process of Al-Killed Steel during Isothermal Annealing, 1971, pp. 20-28.
Jan. 29, 2016 Search Report issued in European Application No. 13823812.6.
Feb. 23, 2016 Office Action issued in Korean Application No. 2015-7000715.
Sep. 21, 2015 Office Action issued in Chinese Application No. 201380037789.1.
Jan. 12, 2017 Office Action Issued in U.S Appl. No. 15/208,720.
Jan. 13, 2017 Office Action issued in U.S. Appl. No. 14/414,623.
Jan. 17, 2017 Notice of Allowance issued in U.S. Appl. No. 14/415,089.
Oct. 15, 2013 International Search Report issued in International Application No. PCT/JP2013/070186.
Aug. 31, 2015 Office Action issued in corresponding Chinese Patent Application No. 201380038008.0 (Translation Only).
Dec. 18, 2015 Office Action issued in U.S. Appl. No. 14/415,089.
Feb. 17, 2016 Extended European Search Report in European Patent Application No. 13822382.1.
Mar. 30, 2016 Office Action issued in Chinese Patent Application No. 201380038008.0.
Sep. 9, 2016 Office Action Issued in U.S. Appl. No. 14/415,089.
Oct. 15, 2013 International Search Report issued in International Application No. PCT/JP2013/070185.
Apr. 7, 2016 Office Action Issued in U.S. Appl. No. 14/415,089.

* cited by examiner

METHOD OF PRODUCING GRAIN-ORIENTED ELECTRICAL STEEL SHEET

TECHNICAL FIELD

This disclosure relates to a method of producing a grain-oriented electrical steel sheet having an excellent iron loss property.

BACKGROUND

The grain-oriented electrical steel sheet is a soft magnetic material, a crystal orientation of which being highly accumulated into Goss orientation ({110}<001>), and is mainly used in an iron core for transformers, an iron core for electric motors or the like. Among them, the grain-oriented electrical steel sheets used in the transformer are strongly demanded to have low iron loss for reducing no-load loss (energy loss). As a way for decreasing the iron loss, it is known that decrease of sheet thickness, increase of Si addition amount, improvement of crystal orientation, application of tension to steel sheet, smoothening of steel sheet surface, refining of secondary recrystallization structure and so on are effective.

As a technique for refining secondary recrystallized grains among the above ways are proposed a method of performing rapid heating during decarburization annealing as disclosed in Patent Documents 1-4, a method of performing rapid heating just before decarburization annealing to improve primary recrystallization texture, and so on. For instance, Patent Document 1 discloses a technique of providing a grain-oriented electrical steel sheet with a low iron loss by heating a cold rolled steel sheet rolled to a final thickness up to a temperature of not lower than 700° C. in a non-oxidizing atmosphere having $P_{H2O}/P_{H2}$ of not more than 0.2 at a heating rate of not less than 100° C./s just before decarburization annealing. Also, Patent Document 3 and the like disclose a technique wherein electrical steel sheets having excellent coating properties and magnetic properties are obtained by heating a temperature zone of not lower than 600° C. at a heating rate of not less than 95° C./s to not lower than 800° C. and properly controlling an atmosphere of this temperature zone.

In these techniques of improving the primary recrystallized texture by the rapid heating, the heating rate is unambiguously defined with respect to a temperature range of roughly from room temperature to not lower than 700° C. as a temperature range for rapid heating. According to this technical idea, it is understood that the improvement of the primary recrystallized texture is attempted by raising the temperature close to a recrystallization temperature for a short time to suppress growth of γ-fibers ({111} fiber structure), which is preferentially formed by usual heating rate, and promote generation of {110}<001> structure as nuclei for secondary recrystallization. By the application of this technique can be refined secondary recrystallized grains to improve iron loss.

In the above technique of performing the rapid heating, it is said that large effects are obtained at a heating rate of not less than about 80° C./s or a further higher heating rate though the effect by the rapid heating may be developed at not less than 50° C./s by properly controlling the rolling conditions as disclosed in Patent Document 5. In order to increase the heating rate, however, there are problems that special and large-size heating installations such as induction heating, electric heating and the like are required and input of large energy is required in a short time. Also, there is a problem that the form of the steel sheet is deteriorated to lower sheet threading performance in the production line due to sharp temperature change through the rapid heating.

PRIOR ART DOCUMENTS

Patent Documents

Patent Document 1: JP-A-H07-062436
Patent Document 2: JP-A-H10-298653
Patent Document 3: JP-A-2003-027194
Patent Document 4: JP-A-2000-204450
Patent Document 5: JP-A-H07-062437

SUMMARY

Task to be Solved

Disclosed embodiments are made in view of the above problems of the conventional techniques and is to propose a production method wherein the effects equal to those by the further higher heating rate are obtained when the heating rate in primary recrystallization annealing is as high as not less than 80° C./s as in the conventional technique, while the effects by the rapid heating are developed even when the heating rate is as relatively low as less than 80° C./s, whereby the refining of secondary recrystallized grains can be attained more efficiently as compared with the conventional technique to stably obtain grain-oriented electrical steel sheets with a low iron loss.

Solution for Task

Various studies have been made on a concept of heat cycle in primary recrystallization annealing, particularly a heating rate (heating pattern) for solving the above task from various angles. As previously mentioned, it is considered that the purpose for rapidly heating up to a temperature of about 700° C. in the heating process of the primary recrystallization annealing lies in that a temperature range of 550° C. and 580° C. as a temperature zone of preferentially promoting {222} recrystallization of γ-fiber {111} fiber structure is passed in a short time to relatively promote {110} recrystallization of Goss structure ({110}<001>).

On the contrary, a temperature zone lower than a temperature range 550 to 700° C. of preferentially growing {222} in the heating process causes recovery of the structure and polygonization of dislocation to lower dislocation density, but is not sufficient for performing recrystallization. Therefore, the recrystallization of {222} is not substantially promoted even if the temperature is kept at such a temperature zone for a long time. However, it has been found that since the dislocation density is largely lowered at such a temperature zone as strain is stored in the structure, a large change is caused in the primary recrystallization texture by keeping at such a zone for a short time, whereby the refining effect of secondary recrystallized grains can be developed effectively, and as a result, disclosed embodiments have been accomplished.

There is provided a method of producing a grain-oriented electrical steel sheet by hot rolling a steel slab having a chemical composition comprising C: 0.001 to 0.10 mass %, Si: 1.0 to 5.0 mass %, Mn: 0.01 to 0.5 mass %, one or two selected from S and Se: 0.01 to 0.05 mass % in total, sol. Al: 0.003 to 0.050 mass % and N: 0.0010 to 0.020 mass % and the remainder being Fe and inevitable impurities, subjecting to single cold rolling or two or more cold rollings including an intermediate annealing therebetween to a final thickness after or without a hot band annealing, performing primary recrystallization annealing, and thereafter applying an annealing separator to perform final annealing, characterized in that a temperature range of 550° C. to 700° C. in a heating process of the primary recrystallization annealing is rapidly heated at an average heating rate of 40 to 200° C./s, while any temperature zone of from 250° C. to 550° C. is kept at a heating rate of not more than 10° C./s for 1 to 10 seconds.

In the production method of the grain-oriented electrical steel sheet according to embodiments, the steel slab contains one or more selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass %, Bi: 0.001 to 0.1 mass %, Ti: 0.005 to 0.02 mass %, P: 0.001 to 0.05 mass % and Nb: 0.0005 to 0.0100 mass % in addition to the above chemical composition.

Effects

According to embodiments, the refining effect of secondary recrystallized grains equal to or more than that of the conventional technique performing the rapid heating at a higher heating rate can be developed even if the heating rate in the heating process of the primary recrystallization annealing is relatively low, so that it is possible to easily and stably obtain grain-oriented electrical steel sheets with a low iron loss.

DETAILED DESCRIPTION

Figure 1:
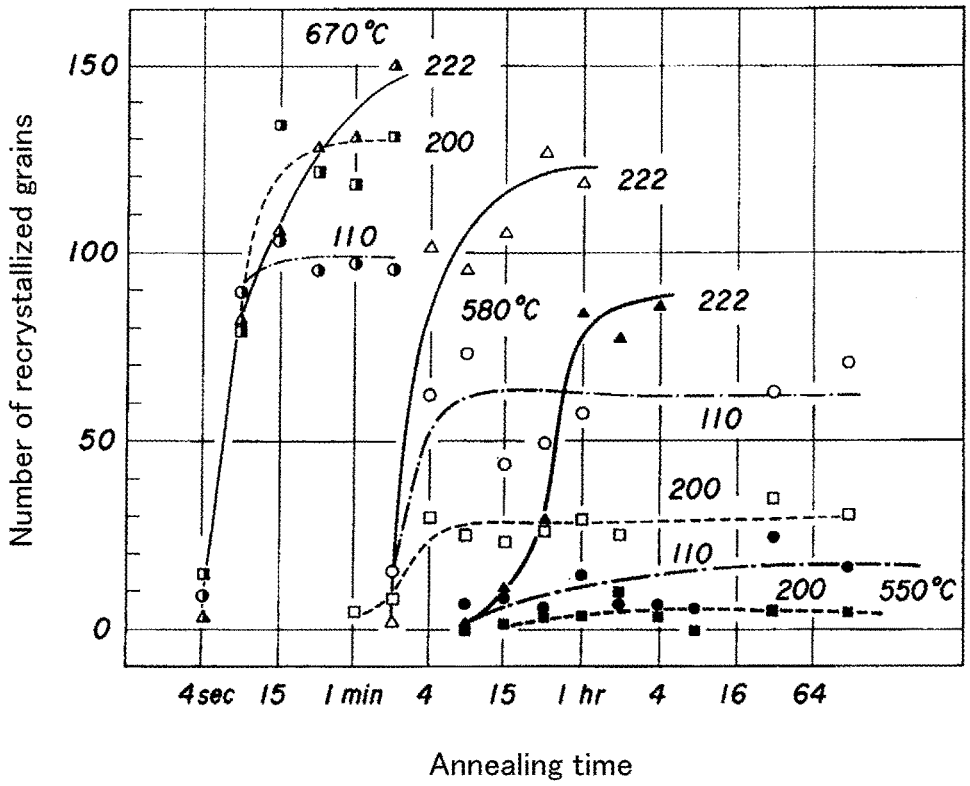
FIG. 1 (RELATED ART)
FIG. 1 is a graph showing an influence of an annealing temperature upon (a relation between) annealing time and number of recrystallized grains in Al-killed steel, which corresponds to FIG. 5 in SHIRAIWA ET AL, "Recrystallization Process of Al-Killed Steel during Isothermal Annealing," 1971, pp. 20-28.
Figure 2:
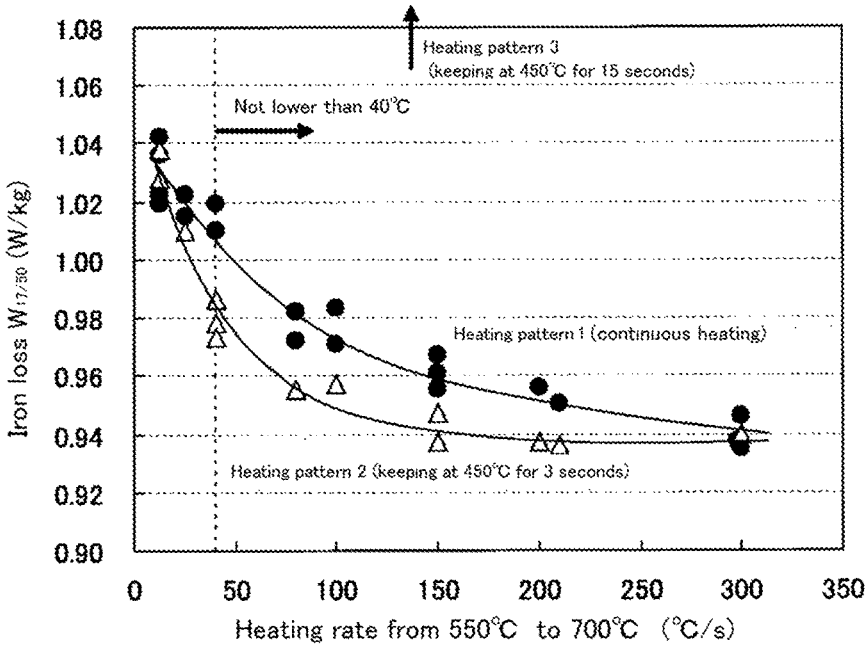
FIG. 2 is a graph showing an influence of a heating pattern upon a relation between a heating rate at 550 to 700° C. and an iron loss.
Figure 3:
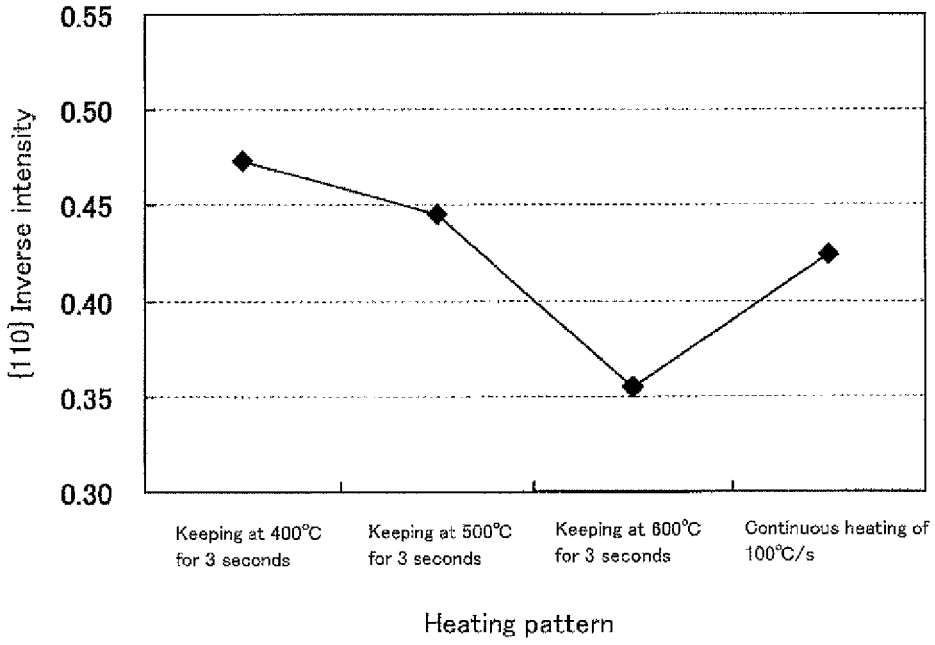
FIG. 3 is a graph showing an influence of a heating pattern upon {110} inverse intensity.

There will be described experiments leading to the development of disclosed embodiments.

Experiment 1

A steel slab having a chemical composition comprising C: 0.05 mass %, Si: 3.4 mass %, Mn: 0.05 mass %, Al: 0.020 mass %, N: 0.0100 mass %, S: 0.0030 mass %, Se: 0.01 mass %, Sb: 0.01 mass %, Ti: 0.001 mass % and the remainder being Fe and inevitable impurities is hot rolled to form a hot rolled sheet, which is subjected to a hot band annealing and two cold rollings including an intermediate annealing of 1100° C. therebetween to form a cold rolled sheet having a thickness of 0.30 mm. Thereafter, 30 test specimens of L: 300 mm×C: 100 mm are cut out from a longitudinal and widthwise central part of the cold rolled sheet (coil).

Then, the test specimens are subjected to primary recrystallization annealing combined with decarburization annealing by heating the specimen to a temperature of 700° C. at various heating rates, heating to 800° C. at 30° C./s and keeping in a wet hydrogen atmosphere for 60 seconds with an electric heating apparatus. Moreover, the heating in the primary recrystallization annealing is performed by three heating patterns, i.e. a heating pattern 1 wherein a temperature is continuously raised from room temperature to 700° C. at a constant heating rate and heating from 700° C. to 800° C. is conducted at a constant heating rate, a heating pattern 2 wherein at 450° C. on the way of heating to 700° C. the temperature is kept for 3 seconds, and a heating pattern 3 wherein at 450° C. on the way of heating to 700° C. the temperature is kept for 15 seconds. The heating rate in the heating patterns 2 and 3 means a heating rate before and after the above keeping, and all of atmosphere condition and the like in the heating patterns 2 and 3 are the same as that in the heating pattern 1.

An annealing separator composed mainly of MgO is applied to the surface of the test specimen after the primary recrystallization (decarburization) annealing, which is subjected to secondary recrystallization annealing (final annealing) at 1150° C. for 10 hours and coated and baked with a phosphate-based insulating tension coating.

For the test specimens thus obtained after the final annealing is measured iron loss $W_{17/50}$ (iron loss in excitation to a magnetic flux density of 1.7 T at a commercial frequency of 50 Hz) with SST (single sheet tester) to obtain results shown in FIG. 1. As seen from this figure, good iron loss is obtained in the heating pattern 2 of keeping 450° C. for 3 seconds on the way of the heating as compared with the heating pattern 1 of continuously raising the temperature. For example, even when the heating rate is 40° C./s in the heating pattern 2, iron loss equal to the case that the heating rate in the heating pattern 1 is 80° C./s is obtained. On the other hand, in the heating pattern 3 of keeping 450° C. for 15 seconds on the way of the heating, the iron loss $W_{17/50}$ in all of the test specimens is not less than 1.10 W/kg (not shown), and further secondary recrystallization itself is not caused when the heating rate is not less than 100° C./s.

Experiment 2

Test specimens of the same size are taken out from the same positions of the cold rolled coil obtained in Experiment 1 and heated with an electric heating apparatus under a condition of continuously heating from room temperature to 700° C. at an annealing rate of 100° C./s or a condition of keeping any temperature of 400° C., 500° C. and 600° C. on the way of the heating from room temperature to 700° C. at an annealing rate of 100° C./s, and subjected to primary recrystallization annealing combined with decarburization annealing by heating from 700° C. to 800° C. at a heating rate of 30° C./s and keeping in a wet hydrogen atmosphere for 60 seconds. For the primary recrystallization annealed sheets thus obtained is measured an inverse intensity by an X-ray diffractometry, from which it has been confirmed that {110} inverse intensity in case of keeping 400° C. or 500° C. is higher as compared to the case of keeping 600° C. or the case of continuously heating at 40° C./s and is equal to or more than the case of rapidly heating at 100° C./s. That is, recrystallization of Goss oriented ({110}<001>) grains as nuclei in secondary recrystallization is promoted.

A mechanism of causing such a phenomenon is considered as follows.

In general, driving force causing recrystallization is strain energy. It is considered that the release of strain energy is easily caused in a portion having high strain energy. A phenomenon of preferential recrystallization of {222} as recognized in technical literature (Shiraiwa, Terasaki, Kodama, "Recrystallization process of Al-killed steel during isothermal annealing", Journal of the Japan Institute of Metals and Materials, vol. 35, No. 1, p 20) shows that high strain energy is stored in {222} structure.

When the cold rolled steel sheet is kept for a short time in a temperature zone of recovering structure through polygonization of dislocation and decrease in strain energy, the decrease of strain energy becomes large in {222} having a high strain energy as compared to the other crystal orientations. As a result, when the sheet is kept at a temperature causing the recovery, the difference of strain energy accumulation depending on the structure is lost to lower preferential growth of {222} structure in the recrystallization. The effect of keeping on the way of the heating is the same as the effect by rapid heating at a higher heating rate from a viewpoint of the texture formed after the primary recrystallization annealing.

When the sheet is kept at a temperature zone of recovering the structure beyond necessity, the strain energy is decreased to cause recrystallization of {222} structure and hence driving force is considerably decreased. Since {222} structure is necessary to be existent in a constant amount as a structure encroached by Goss grains, there is a high possibility that primary recrystallization structure sufficient for secondary recrystallization is not obtained because {222} structure is excessively suppressed. Therefore, it is considered that when the heating rate is relatively slow, the effects equal to those of the higher heating rate are obtained only if the temperature zone of recovering the structure is kept for an extremely short time. Also, it is considered that the effects equal to those of a condition that the heating rate is further higher are obtained even when the heating rate is high.

The chemical composition of the grain-oriented electrical steel sheet targeted by disclosed embodiments will be described below.

C: 0.001 to 0.10 mass %

C is an ingredient useful for the generation of Goss oriented grains and is necessary to be not less than 0.001 mass % for effectively developing such an action. On the other hand, when C content exceeds 0.10 mass %, there is a risk of causing insufficient decarburization in the decarburization annealing. Therefore, C content is a range of 0.001 to 0.10 mass %. Preferably, it is a range of 0.01 to 0.08 mass %.

Si: 1.0 to 5.0 mass %

Si has an effect of increasing electrical resistance of steel to decrease an iron loss and is necessary to be at least 1.0 mass %. On the other hand, when it exceeds 5.0 mass %, it is difficult to perform cold rolling. Therefore, Si content is a range of 1.0 to 5.0 mass %. Preferably, it is a range of 2.0 to 4.5 mass %.

Mn: 0.01 to 0.5 mass %

Mn is effective for improving hot workability of steel but also is an element forming precipitates of MnS, MnSe or the like to act as an inhibitor (grain growth inhibitor). The above effects are obtained by including in an amount of not less than 0.01 mass %. On the other hand, when it exceeds 0.5 mass %, a slab heating temperature for dissolving precipitates of MnS, MnSe or the like is undesirably made higher. Therefore, Mn content is a range of 0.01 to 0.5 mass %. Preferably, it is a range of 0.01 to 0.10 mass %.

One or more of S and Se: 0.01 to 0.05 mass % in total

S and Se are ingredients useful for exerting an inhibitor action as a secondary dispersion phase in steel by bonding with Mn or Cu to form MnS, MnSe, $Cu_{2-x}S$ or $Cu_{2-x}Se$. When the total content of S and Se is less than 0.01 mass %, the addition effect is insufficient, while when it exceeds 0.05 mass %, solid solution is incomplete in the heating of the slab and also surface defect is caused in the product. Therefore, even in either of the single addition and composite addition, the total content is a range of 0.01 to 0.05 mass %.

Sol. Al: 0.003 to 0.050 mass %

Al is a useful ingredient for exerting an inhibitor action as a secondary dispersion phase by forming AlN in steel. When the addition amount is less than 0.003 mass %, sufficient precipitation amount cannot be ensured and the above effect is not obtained. While, when it exceeds 0.050 mass %, the slab heating temperature required for solid solution of AlN becomes higher and AlN is coarsened even by heat treatment after hot rolling to lose the action as an inhibitor. Therefore, Al content as sol. Al is a range of 0.003 to 0.050 mass %. Preferably, it is a range of 0.01 to 0.04 mass %.

N: 0.0010 to 0.020 mass %

N is an ingredient required for exerting an inhibitor action by forming AlN with Al. However, when the addition amount is less than 0.0010 mass %, the precipitation of AlN is insufficient, while when it exceeds 0.020 mass %, swelling or the like is caused in the heating of the slab. Therefore, N content is a range of 0.001 to 0.020 mass %.

The remainder other than the above ingredients in the grain-oriented electrical steel sheet targeted by embodiments is Fe and inevitable impurities. However, the grain-oriented electrical steel sheet according to embodiments may contain one or more selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass %, Bi: 0.001 to 0.1 mass %, Ti: 0.005 to 0.02 mass %, P: 0.001 to 0.05 mass % and Nb: 0.0005 to 0.0100 mass % for the purpose of improving the magnetic properties in addition to the above essential ingredients.

They are elements having an auxiliary action as an inhibitor by segregation in grain boundary or surface of the crystal or by formation of carbonitride. By adding these elements can be suppressed coarsening of primary grains at a higher temperature zone in the secondary recrystallization process. However, when the addition amount is less than the lower limit of the above range, the above addition effect is small, while when it exceeds the upper limit of the above range, poor appearance of coating or poor secondary recrystallization is easily caused.

The production method of the grain-oriented electrical steel sheet according to embodiments will be described below.

The production method of the grain-oriented electrical steel sheet according to embodiments is a production method comprising a series of steps of hot rolling a steel slab having the above chemical composition, subjecting to single cold rolling or two or more cold rollings including an intermediate annealing therebetween to a final thickness after or without a hot band annealing, performing primary recrystallization annealing and thereafter applying an annealing separator to perform secondary recrystallization annealing.

The production method of the steel slab is not particularly limited. The steel slab can be produced by melting a steel of the aforementioned chemical composition through the conventionally well-known refining process and then subjecting to a continuous casting method, an ingot making-blooming method or the like.

Thereafter, the steel slab is subjected to hot rolling. The reheating temperature of the slab prior to the hot rolling is preferable to be not lower than 1300° C. because it is necessary to dissolve the inhibitor ingredients completely.

The hot rolled sheet obtained by hot rolling is subjected to single cold rolling or two or more cold rollings including an intermediate annealing therebetween after or without a hot band annealing to form a cold rolled sheet having a final thickness. Moreover, production conditions from the hot rolling to the cold rolling are not particularly limited, so that these steps may be performed according to the usual manner.

Then, the cold rolled sheet having the final thickness is subjected to primary recrystallization annealing. In the heating of the primary recrystallization annealing, it is necessary that rapid heating is performed between 550° C. and 700° C. at an average heating rate of 40 to 200° C./s and also a heating rate of not more than 10° C./s is kept at any temperature zone of 250 to 550° C. for 1-10 seconds as a previous stage thereof.

The reason why the temperature zone performing the rapid heating is a range of 550 to 700° C. is due to the fact that this temperature zone is a temperature range preferentially recrystallizing {222} as disclosed in the aforementioned technical literatures and the generation of {110}<001> orientation as nuclei for secondary recrystallization can be promoted by performing the rapid heating within this temperature range, whereby the secondary recrystallization texture can be refined to improve the iron loss.

Also, the reason why the average heating rate within the above temperature range is 40 to 200° C./s is based on the fact that when the rate is less than 40° C./s, the effect of improving the iron loss is insufficient, while when it exceeds 200° C./s, the effect of improving the iron loss is saturated.

Further, the reason why the heating rate of not more than 10° C./s at any temperature zone of 250 to 550° C. is kept for 1-10 seconds is due to the fact that the effect of improving the iron loss can be obtained even if the zone of 550 to 700° C. is heated at a lower heating rate as compared to the conventional technique of continuously raising the temperature. Moreover, the heating rate of not more than 10° C./s may be a negative heating rate as long as the temperature of the steel sheet does not deviate from the zone of 250 to 550° C.

That is, disclosed embodiments are based on a technical idea that the superiority of {222} recrystallization is decreased by keeping the temperature zone, which causes loss of dislocation density and does not cause recrystallization, for the short time. Therefore, the above effect cannot be obtained at a temperature of lower than 250° C. substantially anticipating no movement of dislocation, while when the temperature exceeds 550° C., recrystallization of {222} starts, so that the generation of {110}<001> orientation cannot be promoted even if the sheet is kept at a temperature exceeding 550° C. When the keeping time is less than 1 second, the effect is not sufficient, while when it exceeds 10 seconds, the recovery is too promoted and there is a risk of causing poor secondary recrystallization.

Moreover, the primary recrystallization annealing applied to the steel sheet after the final cold rolling is frequently performed in combination with decarburization annealing. Even in embodiments, the primary recrystallization annealing may be combined with decarburization annealing. That is, after the heating is performed to a given temperature at a heating rate adapted to embodiments, decarburization annealing may be conducted, for example, in such an atmosphere that $P_{H2O}/P_{H2}$ is not less than 0.1. If the above annealing is impossible, the primary recrystallization annealing is performed at a heating rate adapted to embodiments in a non-oxidizing atmosphere, and thereafter decarburization annealing may be separately conducted in the above atmosphere.

Then, the steel sheet subjected to the primary recrystallization annealing satisfying the above conditions is coated on its surface with an annealing separator, dried and subjected to final annealing for secondary recrystallization. As the annealing separator may be used ones composed mainly of MgO and properly added with $TiO_2$ or the like, if necessary, or ones composed mainly of $SiO_2$ or $Al_2O_3$, and so on. Moreover, the conditions of final annealing are not particularly limited, and may be conducted according to the usual manner.

It is preferable that the steel sheet after the final annealing is then coated and baked on its surface with an insulation coating, or subjected to a flattening annealing combined with baking and shape correction after the application of the insulation coating to the steel sheet surface to thereby obtain a product. Moreover, the kind of the insulation coating is not particularly limited, but when an insulation coating is formed on the surface of the steel sheet to apply tensile tension thereto, it is preferable that a solution containing phosphate-chromic acid-colloidal silica as described in JP-A-S50-79442 or JP-A-S48-39338 is baked at about 800° C. When the annealing separator composed mainly of $SiO_2$ or $Al_2O_3$ is used, forsterite coating is not formed on the surface of the steel sheet after the final annealing, so that aqueous slurry composed mainly of MgO is newly applied to conduct annealing for the formation of forsterite coating and thereafter the insulation coating may be formed.

According to the production method of embodiments as mentioned above, the secondary recrystallization structure can be stably refined over approximately a full length of a product coil to provide good iron loss properties.

EXAMPLE 1

A steel slab containing C: 0.04 mass %, Si: 3.3 mass %, Mn: 0.03 mass %, S: 0.008 mass %, Se: 0.01 mass %, Al: 0.03 mass %, N: 0.01 mass %, Cu: 0.03 mass % and Sb: 0.01 mass % is heated at 1350° C. for 40 minutes, hot rolled to form a hot rolled sheet of 2.2 mm in thickness, subjected to a hot band annealing at 1000° C. for 2 minutes and further to two cold rollings including an intermediate annealing of 1100° C.×2 minutes to form a cold rolled coil having a final thickness of 0.23 mm, which is subjected to a magnetic domain subdividing treatment by electrolytic etching to form linear grooves having a depth of 20 μm on the surface of the steel sheet in a direction of 90° with respect to the rolling direction.

Samples of L: 300 mm×C: 100 mm are taken out from longitudinal and widthwise central parts of the cold rolled coil thus obtained, which are subjected to a primary recrystallization annealing combined with decarburization annealing with an induction heating apparatus in a laboratory. In the primary recrystallization annealing, heating is conducted by two kinds of patterns, i.e. a pattern of continuously heating from room temperature (RT) to 700° C. at a constant heating rate of 20 to 300° C. (No. 1, 2, 9, 11, 13) and a pattern of heating a zone of T1-T2 on the way of the heating between the above temperatures at a given heating rate for a given time (No. 3-8, 10, 12) as shown in Table 1, and thereafter heating from 700° C. to 820° C. is performed at a heating rate of 40° C./s and decarburization is conducted in a wet hydrogen atmosphere at 820° C. for 2 minutes.

Then, the sample after the primary recrystallization annealing is coated with an aqueous slurry of an annealing separator composed mainly of MgO and containing 5 mass % of $TiO_2$, dried and subjected to a final annealing, and coated and baked with a phosphate-based insulation tensile coating to obtain a grain-oriented electrical steel sheet.

For the samples thus obtained is measured iron loss $W_{17/50}$ by a single sheet magnetic testing method (SST), and then pickling is performed to remove the insulation coating and forsterite coating from the surface of the steel sheet and thereafter a particle size of secondary recrystallized grains is measured. Moreover, the iron loss property is measured on 20 samples per one heating condition and evaluated by an average value. Also, the grain size of the secondary recrystallized grains is measured by a linear analysis on a test specimen of 300 mm in length.

The measured results are also shown in Table 1. As seen from these results, the steel sheets subjected to the primary recrystallization annealing under conditions adapted to embodiments are small in the secondary recrystallized grain size and good in the iron loss property, and especially the effect of decreasing the iron loss is large when the heating rate between RT and 700° C. is as low as 50° C./s.

TABLE 1

| | Heating conditions of primary recrystallization annealing | | | | | Properties of steel sheet | | |
|---|---|---|---|---|---|---|---|---|
| No. | Heating rate between RT and 700° C. (° C./s) | T1 (° C.) | T2 (° C.) | Heating rate (° C./s) | Keeping time (s) | Particle size of secondary recrystallized grains (mm) | Iron loss $W_{17/50}$ (W/kg) | Remarks |
| 1 | 20 | — | — | — | — | 15.5 | 0.790 | Comparative Example |
| 2 | 50 | — | — | — | — | 16.5 | 0.785 | Comparative Example |
| 3 | 50 | 200 | 200 | 0 | 3 | 16.6 | 0.797 | Comparative Example |
| 4 | 50 | 450 | 450 | 0 | 3 | 10.5 | 0.743 | Invention Example |
| 5 | 50 | 450 | 450 | 0 | 11 | 18.9 | 0.830 | Comparative Example |
| 6 | 50 | 450 | 483 | 11 | 3 | 16.8 | 0.753 | Comparative Example |
| 7 | 50 | 530 | 550 | 10 | 2 | 10.6 | 0.749 | Invention Example |
| 8 | 50 | 560 | 570 | 5 | 2 | 17.5 | 0.823 | Comparative Example |
| 9 | 100 | — | — | — | — | 11.3 | 0.747 | Comparative Example |
| 10 | 200 | 380 | 380 | 0 | 7 | 8.5 | 0.709 | Invention Example |
| 11 | 200 | — | — | — | — | 11.8 | 0.753 | Comparative Example |
| 12 | 300 | 380 | 380 | 0 | 7 | 8.3 | 0.717 | Comparative Example |
| 13 | 300 | — | — | — | — | 8.9 | 0.729 | Comparative Example |

EXAMPLE 2

A steel slab having a chemical composition shown in Table 2 is heated at 1400° C. for 60 minutes, hot rolled to form a hot rolled sheet of 2.3 mm in thickness, subjected to an annealing at 1100° C. for 3 minutes and further to a warm rolling inclusive of coiling above 200° C. in the middle thereof to form a cold rolled sheet having a final thickness of 0.23 mm, which is subjected to a magnetic domain subdividing treatment by electrolytic etching to form linear grooves on the surface of the steel sheet.

Then, the sheet is subjected to a primary recrystallization annealing combined with decarburization annealing by heating from room temperature to 750° C. at various heating rates shown in Table 2, heating from 750° C. to 840° C. at a heating rate of 10° C./s and keeping in a wet hydrogen atmosphere of $P_{H2O}/P_{H2}$=0.3 for 2 minutes, coated with an aqueous slurry of an annealing separator composed mainly of MgO and containing 10 mass % of $TiO_2$, dried, coiled, subjected to a final annealing, coated and baked with a phosphate-based insulation tensile coating and subjected to a flattening annealing combined with baking and shape correction to thereby obtain a product coil of a grain-oriented electrical steel sheet.

Test specimens of L: 320 mm×C: 30 mm are taken out from longitudinal and widthwise central parts of the product coil thus obtained, and iron loss $W_{17/50}$ thereof is measured by an Epstein test to obtain results shown in Table 2. As seen from Table 2, all of the steel sheets Nos. 3-6, 10-12 and 15-18 obtained by performing the heating of primary recrystallization annealing under conditions adapted to embodiments are excellent in the iron loss property.

TABLE 2

| | Chemical composition (mass %) | | | | | | | | Heating rate in primary recrystallization annealing (° C./s) | | | | | Iron loss | |
|---|---|---|---|---|---|---|---|---|---|---|---|---|---|---|---|
| No. | C | Si | Mn | S | Se | Al | N | others | RT~ 400° C. | 400~ 430° C. | 430~ 550° C. | 550~ 700° C. | 700~ 750° C. | $W_{17/50}$ (W/kg) | Remarks |
| 1 | 0.06 | 3.25 | 0.01 | 0.0013 | 0.0170 | 0.0150 | 0.0040 | — | 30 | 30 | 30 | 20 | 20 | 0.824 | Comparative Example |
| 2 | 0.06 | 3.25 | 0.01 | 0.0013 | 0.0170 | 0.0150 | 0.0040 | — | 30 | 250 | 250 | 250 | 20 | 0.721 | Comparative Example |
| 3 | 0.06 | 3.25 | 0.01 | 0.0013 | 0.0170 | 0.0150 | 0.0040 | — | 30 | 5 | 40 | 150 | 20 | 0.723 | Invention Example |
| 4 | 0.06 | 3.25 | 0.01 | 0.0013 | 0.0170 | 0.0150 | 0.0040 | Bi: 0.001 | 30 | 5 | 40 | 150 | 20 | 0.718 | Invention Example |
| 5 | 0.06 | 3.25 | 0.01 | 0.0013 | 0.0170 | 0.0150 | 0.0040 | Sn: 0.02 | 30 | 5 | 40 | 150 | 20 | 0.710 | Invention Example |
| 6 | 0.06 | 3.25 | 0.01 | 0.0013 | 0.0170 | 0.0150 | 0.0040 | Mo: 0.02 | 30 | 5 | 40 | 150 | 20 | 0.715 | Invention Example |
| 7 | 0.04 | 3.33 | 0.03 | 0.0050 | 0.0050 | 0.0210 | 0.0100 | — | 30 | 30 | 30 | 20 | 20 | 0.845 | Comparative Example |

TABLE 2-continued

| | Chemical composition (mass %) | | | | | | | | Heating rate in primary recrystallization annealing (° C./s) | | | | | Iron loss | |
|---|---|---|---|---|---|---|---|---|---|---|---|---|---|---|---|
| | | | | | | | | | RT~ | 400~ | 430~ | 550~ | 700~ | $W_{17/50}$ | |
| No. | C | Si | Mn | S | Se | Al | N | others | 400° C. | 430° C. | 550° C. | 700° C. | 750° C. | (W/kg) | Remarks |
| 8 | 0.04 | 3.33 | 0.03 | 0.0050 | 0.0050 | 0.0210 | 0.0100 | — | 30 | 40 | 40 | 250 | 20 | 0.730 | Comparative Example |
| 9 | 0.04 | 3.33 | 0.03 | 0.0050 | 0.0050 | 0.0210 | 0.0100 | — | 30 | 5 | 10 | 150 | 20 | 0.812 | Comparative Example |
| 10 | 0.04 | 3.33 | 0.03 | 0.0050 | 0.0050 | 0.0210 | 0.0100 | — | 30 | 5 | 40 | 150 | 20 | 0.727 | Invention Example |
| 11 | 0.04 | 3.33 | 0.03 | 0.0050 | 0.0050 | 0.0210 | 0.0100 | Ni: 0.03 | 30 | 5 | 40 | 150 | 20 | 0.720 | Invention Example |
| 12 | 0.04 | 3.33 | 0.03 | 0.0050 | 0.0050 | 0.0210 | 0.0100 | Cr: 0.04 | 30 | 5 | 40 | 150 | 20 | 0.720 | Invention Example |
| 13 | 0.03 | 3.05 | 0.05 | 0.0030 | 0.0160 | 0.0320 | 0.0150 | — | 80 | 30 | 30 | 20 | 20 | 0.831 | Comparative Example |
| 14 | 0.03 | 3.05 | 0.05 | 0.0030 | 0.0160 | 0.0320 | 0.0150 | — | 80 | 80 | 250 | 250 | 20 | 0.725 | Comparative Example |
| 15 | 0.03 | 3.05 | 0.05 | 0.0030 | 0.0160 | 0.0320 | 0.0150 | — | 80 | 3 | 40 | 150 | 20 | 0.728 | Invention Example |
| 16 | 0.03 | 3.05 | 0.05 | 0.0030 | 0.0160 | 0.0320 | 0.0150 | Ti: 0.002 | 80 | 3 | 40 | 150 | 20 | 0.721 | Invention Example |
| 17 | 0.03 | 3.05 | 0.05 | 0.0030 | 0.0160 | 0.0320 | 0.0150 | P: 0.008 | 80 | 3 | 40 | 150 | 20 | 0.722 | Invention Example |
| 18 | 0.03 | 3.05 | 0.05 | 0.0030 | 0.0160 | 0.0320 | 0.0150 | Nb: 0.001 | 80 | 3 | 40 | 150 | 20 | 0.716 | Invention Example |

INDUSTRIAL APPLICABILITY

The technique of disclosed embodiments can be applied to the control of the texture in thin steel sheets.

The invention claimed is:

1. A method of producing a grain-oriented electrical steel sheet, the method comprising:

hot rolling a steel slab to form a hot rolled steel sheet, the steel slab having a chemical composition comprising:
C: 0.001 to 0.10, by mass %;
Si: 1.0 to 5.0, by mass %;
Mn: 0.01 to 0.5, by mass %;
at least one of S and Se: 0.01 to 0.05, by combined mass %;
sol. Al: 0.003 to 0.050, by mass %;
N: 0.0010 to 0.020, by mass %; and
Fe and unavoidable impurities;

optionally hot band annealing the steel sheet;

subjecting the hot rolled steel sheet to a final thickness by (i) single cold rolling or (ii) two or more cold rollings including an intermediate annealing therebetween;

primary recrystallization annealing the cold rolled steel sheet by heating at a heating rate of not more than 10° C./s for a period of 1 to 7 seconds within a temperature zone in a range of 250° C. to less than 550° C. and rapidly heating at an average heating rate in a range of 40 to 200° C./s at a temperature in a range of 550° C. to 700° C.; and thereafter applying an annealing separator to perform final annealing.

2. The method of producing a grain-oriented electrical steel sheet according to claim 1, wherein the steel slab comprises one or more selected from Cu: 0.01 to 0.2, by mass %, Ni: 0.01 to 0.5, by mass %, Cr: 0.01 to 0.5, by mass %, Sb: 0.01 to 0.1, by mass %, Sn: 0.01 to 0.5, by mass %, Mo: 0.01 to 0.5, by mass %, Bi: 0.001 to 0.1, by mass %, Ti: 0.005 to 0.02, by mass %, P: 0.001 to 0.05, by mass % and Nb: 0.0005 to 0.0100, by mass % in addition to the chemical composition.

* * * * *